US006902334B1

(12) United States Patent
Kung

(10) Patent No.: US 6,902,334 B1
(45) Date of Patent: Jun. 7, 2005

(54) BALL-POINT PEN

(75) Inventor: Lin Wei Kung, Tu-cheng (TW)

(73) Assignee: Dong Guan Szu Mao Stationery Gifts, Co., Ltd., Dong Guan (CN)

( * ) Notice: Subject to any disclaimer, the term of this patent is extended or adjusted under 35 U.S.C. 154(b) by 0 days.

(21) Appl. No.: 10/976,891

(22) Filed: Nov. 1, 2004

(51) Int. Cl.[7] ..... B43K 7/12
(52) U.S. Cl. ..... 401/109; 401/99
(58) Field of Search ..... 401/99, 107–109, 401/115, 117

(56) References Cited

U.S. PATENT DOCUMENTS 2,808,032 A * 10/1957 Ducharme ..... 401/103
4,991,988 A * 2/1991 Snell et al. ..... 401/111
6,050,735 A * 4/2000 Hazzard ..... 401/33
6,264,388 B1 * 7/2001 Wang ..... 401/109

* cited by examiner

*Primary Examiner*—Gregory L. Huson
*Assistant Examiner*—Huyen Le
(74) *Attorney, Agent, or Firm*—Dennison, Schultz, Dougherty & MacDonald

(57) ABSTRACT

A ball-point pen comprises: a ball-point pen tip, a coil spring, a refill, a mid tube, a upper tube, a clip, a sliding bar, a lower holder, a pen cap, a back plug spring, a sliding bracket, and a back plug; wherein the refill spring is placed inside the ball-point pen tip holder, the refill is placed inside the space formed between the tip holder and the mid tube, the lower holder is fixed on the pen cap, the sliding base, back plug spring, and back plug is fixed on the lower holder whiling being moveable, the sliding bar is fixed inside the sliding bar, the sliding bar is placed inside the sliding base, the refill is connected to the mid-connected tube, the mid-connected tube is connected to the upper-connected tube, and the upper-connected tube is connected to the pen cap. Accordingly, the characteristic of convenient replacement of refills, comfortable writing, and good appearance with regard to a ball-point pen can be achieved.

7 Claims, 5 Drawing Sheets

BALL-POINT PEN

BACKGROUND OF THE INVENTION

1. Field of the Invention

The present invention relates to a ball-point pen, and more particularly to a triangle-shape ball-point pen which provides an easy and convenient way for replacing refills and has good looks.

2. Description of the Prior Art

A variety of writing materials are present in the market now. Currently, ball-point pens are usually designed to allow for rotating to open or pulling out an upper tube, or rotating to open a ball-point pen tip in order to replace refills. Among the methods, rotating to open or pulling out a ball-point pen tip to replace refills requires strenuous effort. Therefore, high-quality pens rarely adopt this way to replace refills. Also, rotating to open an upper tube to replace refills is time-consuming; pulling out an upper tube to replace refills may lead to the situation that an upper tube is improperly connected to a mid tube with seams and easily being wedged. The conventional way to replace refills mentioned above is time-consuming and indirectly. On the one hand, the cross section of existing ball-points is usually present as spherical-shaped, and such unitary look cannot meet people's demand for pretty individualized things. On the other hand, less contact area between fingers and the pen may make people get tired easily during writing.

Accordingly, the present invention has been made for solving the above-mentioned problems occurred in the prior art.

SUMMARY OF THE INVENTION

Accordingly, the first object of present invention is to provide a ball-point pen for conveniently replacing refills.

The second object of present invention is to provide a ball-point pen with unique and good looks.

The ball-point pen according to the present invention comprises a tip holder, a body tube, a coil spring, a refill, a ball-point pen tip, and an active back plug and push mechanism, wherein said coil spring is provided inside the tip holder, the active back plug and push mechanism is fitted in the back end of body tube being pen capable of sliding, and the refill is placed inside the space formed between the tip holder and body tube. The characteristics of said ball-point pen includes: a concave first stepped portion is formed on the outer surface of the tip holder in contact with one end of said body tube, which has a protruded first snap thereon, and said body tube comprises a mid tube, upper tube, and pen cap; a concave second stepped portion is formed on the outer surface of said mid tube in contact with one end of the upper tube, wherein its extended part has a number of spring. A concave stepped portion is formed in terms of the outer surface formed by the spring and the outer surface of the second stepped portion. The inner side of said spring has a second snap which fits in the first snap. The first stepped portion in said tip holder fits in said mid tube; the second stepped portion in said mid tube fits in the first end of said upper tube; and the second end of said upper tube fits in said pen cap.

As to the ball-point pen of the present invention, when the back plug is pushed downward, the back plug and push mechanism is moved downward. After moved some distance, said back plug and push mechanism is pushed upon the tip holder, then said tip holder is pushed downward by said back plug and push mechanism. When the tip holder's moving distance exceeds the length of clipping between the tip holder and mid tube, said tip holder is free from constraints while the tip holder and refill can be taken out easily. Then, the refill and tip holder are inserted into their original place while said tip holder and mid tube is re-clipped, so that replacement of refills can be achieved.

The ball-point pen according to the present invention provides an easy and convenient way to replace refills. The novelty increases pleasure in writing and meets people's demand for individualization.

In the ball-point pen according to the present invention, the extended surface of upper edge of said first stepped portion in contact with the mid tube has a long orientation bar and short orientation bar, and the inner side of said body tube has a slot fitted in with said long orientation bar. The long and short orientation bars not only have the function of orientation, but also optimize the coupling between the tip holder and mid tube.

In the ball-point pen according to the present invention, the pen cap has a clip and an active back plug and push mechanism is fixed inside said pen cap for easy handheld.

In the ball-point pen according to the present invention, said active back plug and push mechanism includes a push bar, a sliding bar, a sliding base, a lower holder, a back plug spring, and a back plug, wherein said lower holder is fixed on said pen cap; said sliding base, back plug spring, and back plug are fixed inside said lower holder; said push bar is fixed inside said sliding bar; and said sliding bar is fitted in said sliding base. When said back plug is pushed downward, the sliding base is moved up and down inside the slot of said lower holder, so that the sliding bar and push bar are pushed downward. After moved some distance, said push bar is pushed upon the tip holder, then said tip holder is pushed downward by said sliding bar. When said tip holder's moving distance exceeds the length of clipping between the tip holder and mid tube, said tip holder is free from constraints and easy for people to take off in order to replace needed refills. Then, the refill and tip holder are inserted into their original place while said tip holder and mid tube is clipped with each other, so that replacement of refills can be achieved.

In the ball-point pen according to the present invention, said mid tube, upper tube, and the left and right side of said pen cap are present as isosceles surface while another side is arc, whereon the three angles are jointed with each other in terms of the arc. Its cross-sectional view is like a triangle, and this distinctive look can meet people's demand for pretty, individualized things. The three angles thereon cross as arcs. In use of said ball-point pen, the two sides held between the thumb and index finger are isosceles. As the contact area increases and the angles are arranged properly, writing with the two fingers will become quite comfortable. Its plate surface design also facilitates laser patterning thereon. Furthermore, when holding the pen with a part of the hand between the thumb and the index finger is concerned, its arc-shaped look fits in with the soft skin of the hand, which enables people to write a long period of time without feeling tired.

In the ball-point pen according to the present invention, said mid tube, upper tube, and pen cap have no arc in both sides, which allows for comfortable holding.

The ball-point pen according to the present invention provides an easy way to replace refills, makes writing comfortable, and has good looking.

The detailed structure, application principle, function, and efficiency of the present invention will become more apparent by describing the preferred embodiment of the present invention with reference to the attached drawings.

DETAILED DESCRIPTION OF THE PREFERRED EMBODIMENTS

Figure 1:
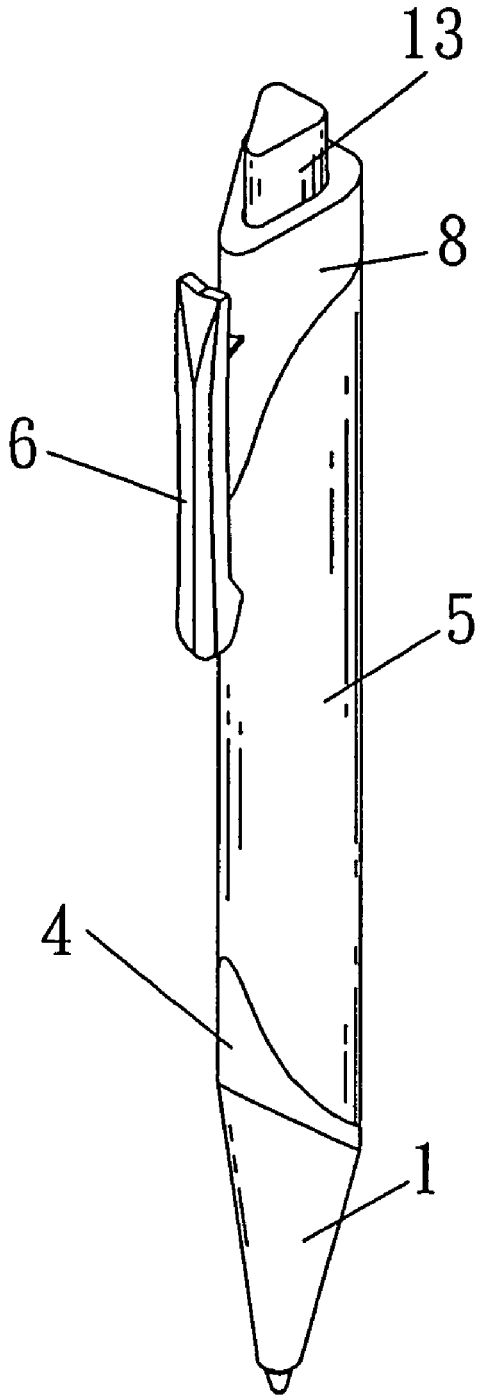
FIG. 1 is a solid combination view according to the present invention.
Figure 2:
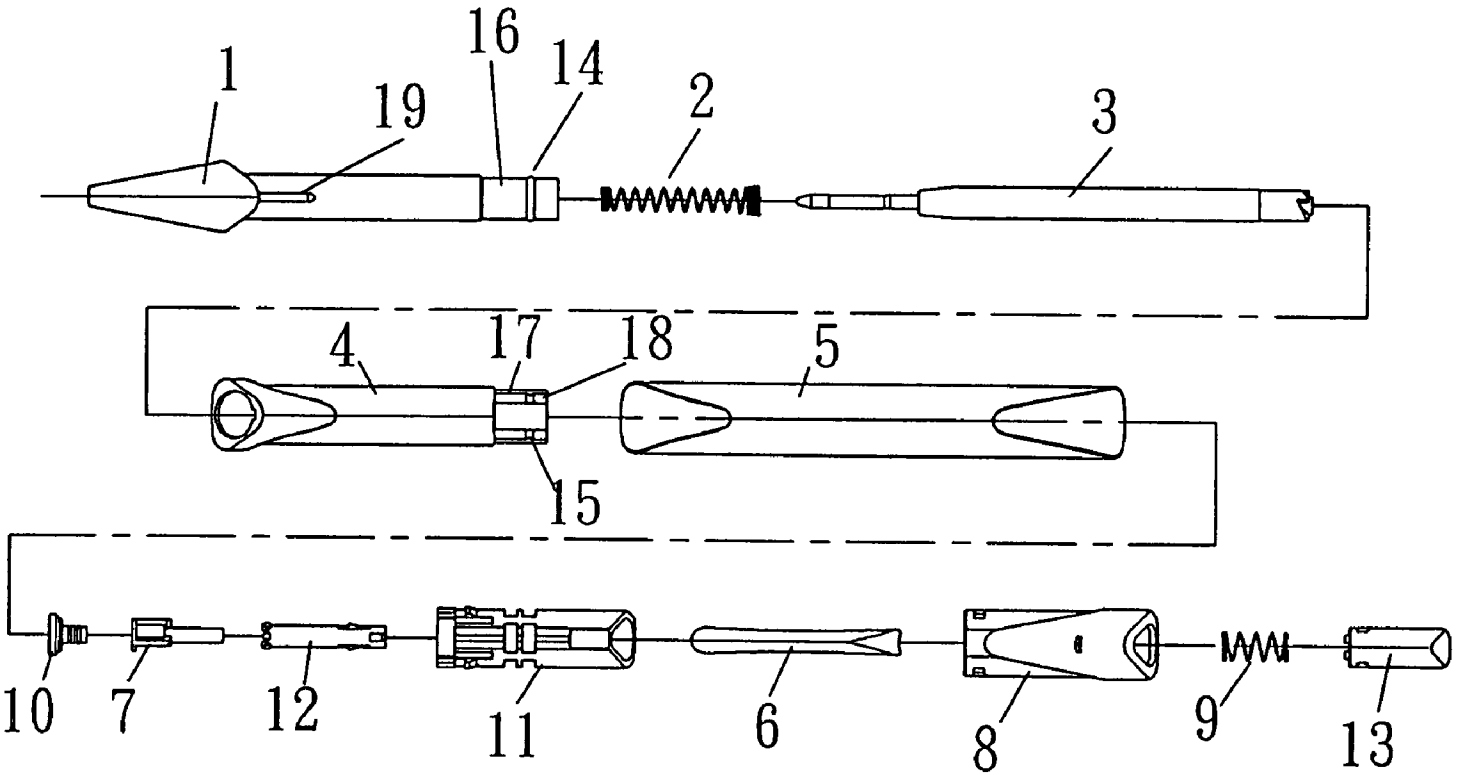
FIG. 2 is a scheme of decomposition in the present invention.
Figure 3:
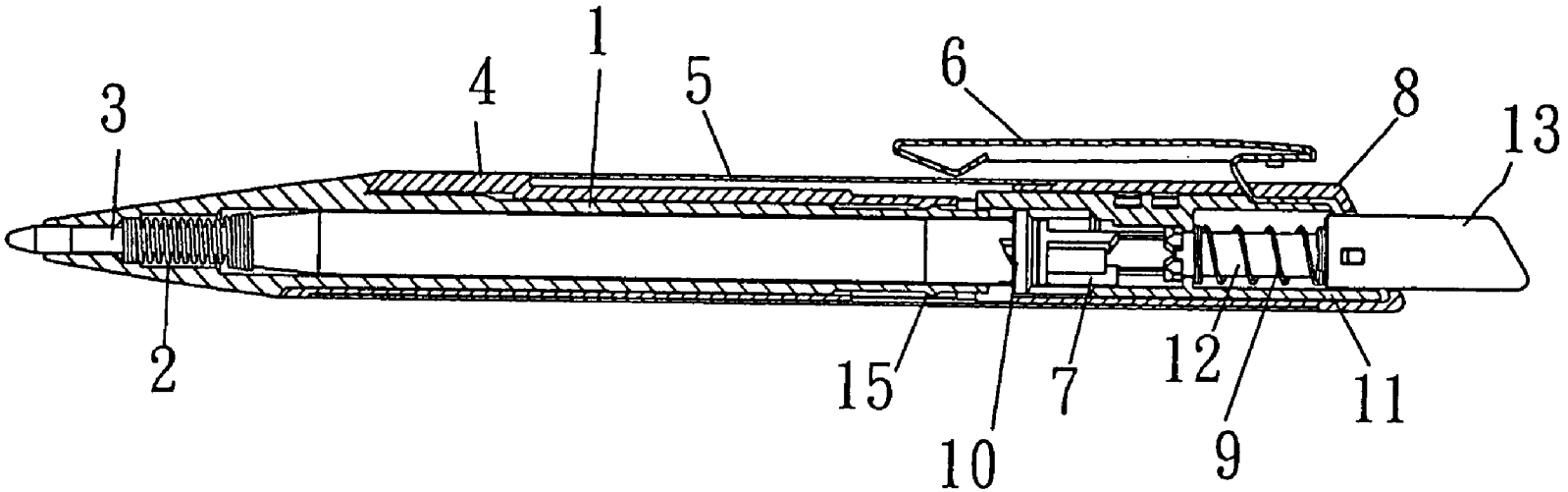
FIG. 3 is a composite sectional view of the present invention.

As shown in FIGS. 1, 2, and 3, the ball-point pen of the present invention includes a tip holder 1, a coil spring 2, a refill 3, a mid tube 4, an upper tube 5, a clip 6, a push bar 10, a sliding bar 7, a lower holder 11, a pen cap 8, a back plug spring 9, a sliding base 12, and a back plug 13, wherein an active back plug and push mechanism is composed of the push bar 10, sliding bar 7, sliding base 12, lower holder 11, back plug spring 9, and back plug 13; coil spring 2 is provided inside said tip holder 1; refill 3 is disposed inside the space formed between tip holder 1 and the body tube; lower holder 11 is fixed on said pen cap 8; sliding base 12, back plug spring 9, and back plug are slidably fixed inside lower holder 11; push bar 10 is fixed inside said sliding bar 7; and sliding bar 7 is placed inside sliding base 12. Also, a concave first stepped portion 16 is formed on the outer surface of the tip holder 1 in contact with one end of said body tube, and a protruded first snap 14 is provided thereon. A concave second stepped portion 17 is formed on the outer surface of the mid tube 4 in contact with one end of the upper tube 5, wherein the extended part has a number of springs 18. A concave stepped portion is formed in terms of the outer surface formed by the spring 18 and the outer surface of the second stepped portion 17. The inner side of said spring 18 has a second snap 15 which fits in the first snap 14. The first stepped portion 16 in the tip holder 1 fits in the mid tube 4; the second stepped portion 17 in the mid tube 4 fits in the first end of the upper tube 5; and the second end of said upper tube 5 fits in the pen cap 8. The extended surface of upper edge of first stepped portion 16 in contact with the mid tube has a long orientation bar 19 and a short orientation bar, and the inner side of the body tube has a slot fitted in with said long orientation bar 19. The mid tube 4, upper tube 5, and the left and right side of the pen cap 8 are present as isosceles surface while another side is arc, whereon the three angles are jointed with each other in terms of the arc. The mid tube 4, upper tube 5, and pen cap 8 has radian is both sides.

Figure 4A:
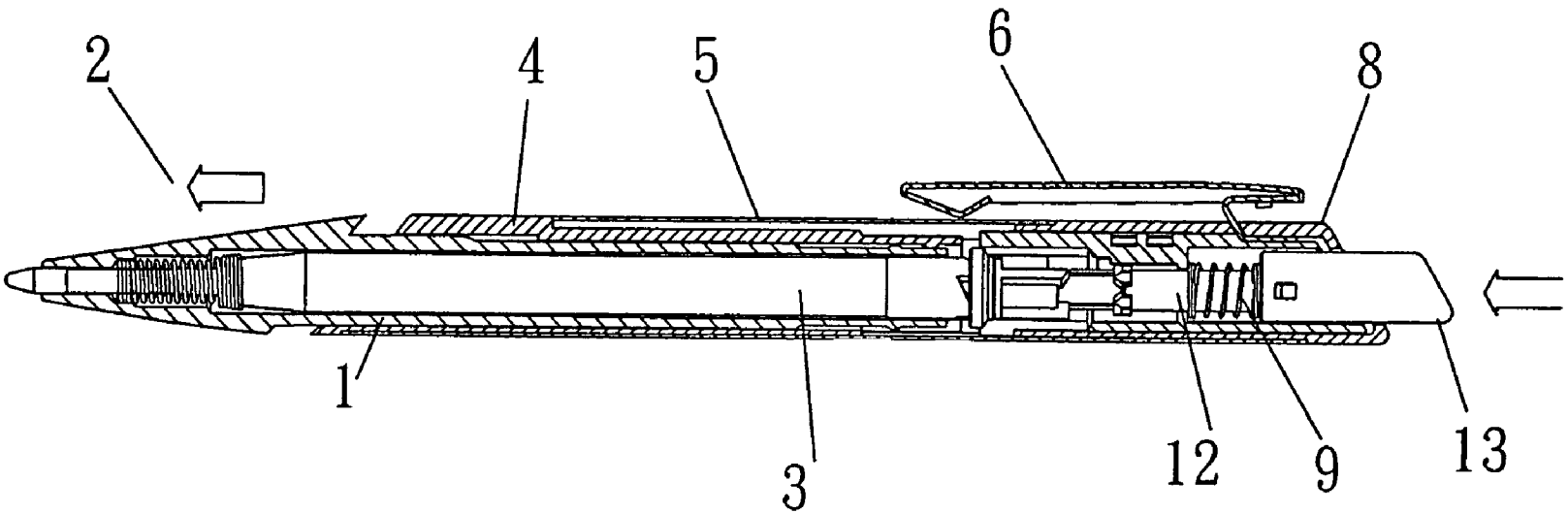
FIG. 4A is a drawing showing the movement according to the present invention.
Figure 4B:
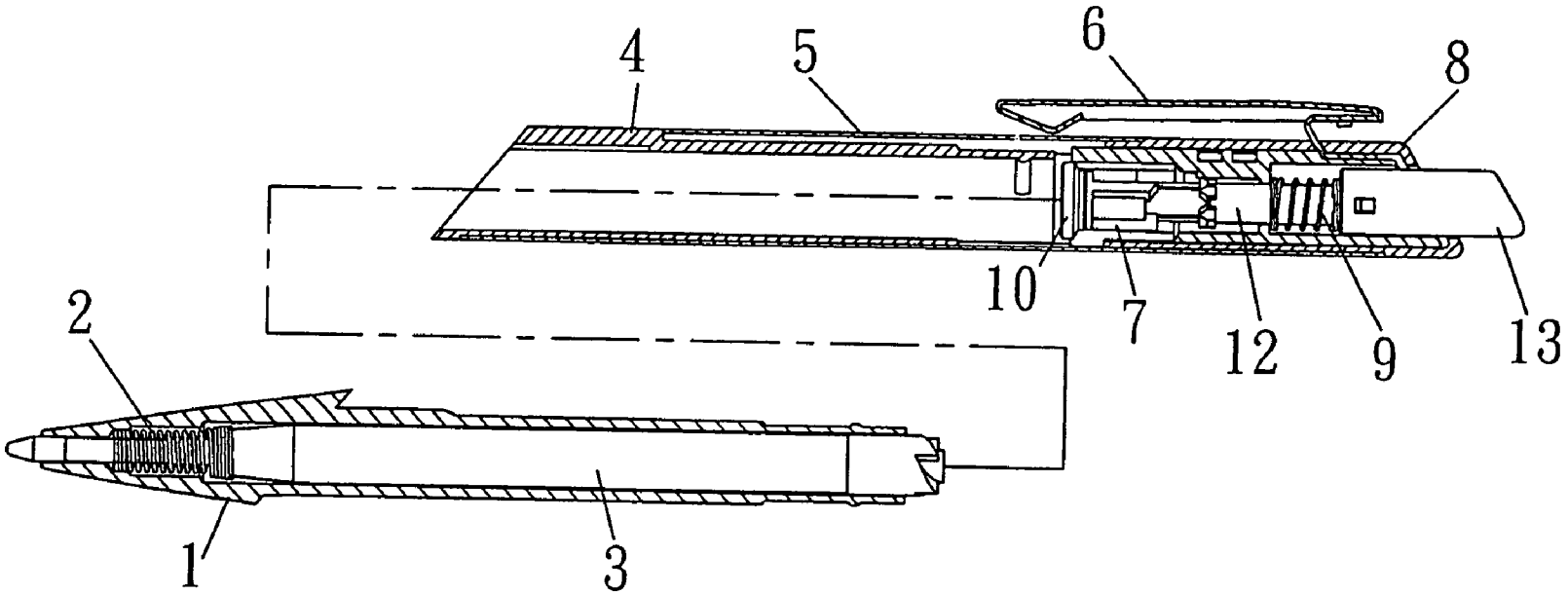
FIG. 4B is an after-movement illustration according to the present invention.

As shown in FIGS. 4A and 4B, when the back plug 13 is pushed downward, the push bar 10, sliding bar 7, sliding base 12, lower holder 11, back plug spring 9, and back plug 13 are pushed downward as well. After moved some distance, the push bar 10 is pushed upon the tip holder 1, then said tip holder 1 is pushed downward as well. When the moving distance of said tip holder 1 exceeds the length of clipping between tip holder 1 and mid tube 4, said tip holder 1 is departed from the mid tube 4, and thus tip holder 1 and refill 3 can be taken out easily for replacement of the refill 3. Then, the refill 3 and tip holder 1 are re-inserted into their original place while tip holder 1 and mid tube 4 is re-clipped. The whole process of replacing refills is quite easy, convenient and novel, which increases pleasure in writing and meets people's demand for pursuing individualized things.

In conclusion from above, the ball-point pen according to the present invention provides easy and convenient way to replace refills and meets people's demand for pursuing individualized things. Also, the present invention has not yet opened to public, it is then complied with the conditions of allowable patents.

Although the above-mentioned embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A ball-point pen, comprising: a tip holder, a body tube, a coil spring, a refill, a ball-point pen tip, and an active back plug and push mechanism, wherein said coil spring is provided inside the tip holder, the active back plug and push mechanism is fitted in the back end of body tube being capable of sliding, the refill is placed inside the space formed between the tip holder and body tube, wherein the characteristic includes: a concave first stepped portion is formed on the outer surface of the tip holder in contact with one end of said body tube, which has a protruded first snap thereon, and said body tube comprises a mid tube, upper tube, and pen cap; a concave second stepped portion is formed on the outer surface of said mid tube in contact with one end of the upper tube, wherein its extended part has a number of spring; a concave stepped portion is formed in terms of the outer surface formed by the spring and the outer surface of the second stepped portion; the inner side of said spring has a snap which fits in the first snap; the first stepped portion in said tip holder fits in said mid tube; the second stepped portion in said mid tube fits in the first end of said upper tube; and the second end of said upper tube fits in said pen cap.

2. The ball-point pen as claimed in claim 1, which is characterized in: the extended surface of upper edge of said first stepped portion in contact with the mid tube has a long orientation bar and short orientation bar, and the inner side of said body tube has a slot fitted in with said long orientation bar.

3. The ball-point pen as claimed in claim 1, which is characterized in: said pen cap has a clip and an active back plug and push mechanism is fixed inside said pen cap.

4. The ball-point pen as claimed in claim 3, which is characterized in: said active back plug and push mechanism includes a push bar, a sliding bar, a sliding base, a lower holder, a back plug spring, and a back plug, wherein said lower holder is fixed on said pen cap; said sliding base, back plug spring, and back plug are fixed inside said lower holder; said push bar is fixed inside said sliding bar; and said sliding bar is fitted in said sliding base.

5. The ball-point pen as claimed in claim 4, which is characterized in: said mid tube, upper tube, and the left and right side of said pen cap are present as isosceles surface while another side is arc, whereon the three angles are jointed with each other in terms of the arc.

6. The ball-point pen as claimed in claim 1, which is characterized in: said active back plug and push mechanism includes a push bar, a sliding bar, a sliding base, a lower holder, a back plug spring, and a back plug, wherein said lower holder is fixed on said pen cap; said sliding base, back plug spring, and back plug are fixed inside said lower holder; said push bar is fixed inside said sliding bar; and said sliding bar is fitted in said sliding base.

7. The ball-point pen as claimed in claim 6, which is characterized in: said mid tube, upper tube, and the left and right side of said pen cap are present as isosceles surface while another side is arc, whereon the three angles are jointed with each other in terms of the arc.

* * * * *